US008170756B2

(12) United States Patent
Morey et al.

(10) Patent No.: US 8,170,756 B2
(45) Date of Patent: May 1, 2012

(54) EXCAVATING SYSTEM UTILIZING MACHINE-TO-MACHINE COMMUNICATION

(75) Inventors: Stephen J. Morey, Peoria, IL (US); Timothy A. Vik, Sparland, IL (US); Quentin D. Burt, Forsyth, IL (US)

(73) Assignee: Caterpillar Inc., Peoria, IL (US)

( * ) Notice: Subject to any disclaimer, the term of this patent is extended or adjusted under 35 U.S.C. 154(b) by 1248 days.

(21) Appl. No.: 11/896,195

(22) Filed: Aug. 30, 2007

(65) Prior Publication Data

US 2009/0062993 A1 Mar. 5, 2009

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |

(52) U.S. Cl. ..... 701/50; 701/1; 701/24; 701/400; 701/468; 318/580; 318/587; 340/435; 340/436; 340/988; 340/989; 280/481; 172/786; 172/788

(58) Field of Classification Search ..... 701/1, 24, 701/50, 200, 213; 318/580, 581, 587; 340/435, 340/436, 988, 989, 990, 991, 992, 993, 994; 348/118, 119, 142; 280/481; 172/788
See application file for complete search history.

(56) References Cited

U.S. PATENT DOCUMENTS

| | | | | |
|---|---|---|---|---|
| 2,986,827 | A | | 6/1961 | Peterson |
| 3,092,921 | A | | 6/1963 | Forst |
| 3,296,885 | A | | 1/1967 | Peterson |
| 3,339,658 | A | | 9/1967 | Peterson |
| 3,906,613 | A | | 9/1975 | Chappell et al. |
| 4,018,452 | A | | 4/1977 | Wagatsuma et al. |
| 4,078,820 | A | * | 3/1978 | Trittipoe ..... 280/481 |
| 4,167,274 | A | * | 9/1979 | Trittipoe ..... 280/481 |
| 4,266,798 | A | | 5/1981 | Smith |
| 4,350,363 | A | | 9/1982 | Waddell et al. |
| 4,933,853 | A | | 6/1990 | Musil et al. |
| 4,986,384 | A | * | 1/1991 | Okamoto et al. ..... 180/167 |
| 5,295,551 | A | * | 3/1994 | Sukonick ..... 180/167 |
| 5,501,566 | A | * | 3/1996 | Engle ..... 414/333 |
| 6,044,312 | A | * | 3/2000 | Sudo et al. ..... 701/25 |
| 6,226,572 | B1 | * | 5/2001 | Tojima et al. ..... 701/23 |
| 6,246,932 | B1 | * | 6/2001 | Kageyama et al. ..... 701/24 |
| 6,247,538 | B1 | * | 6/2001 | Takeda et al. ..... 172/2 |
| 6,582,033 | B2 | | 6/2003 | Leseky et al. |
| 6,778,893 | B2 | | 8/2004 | Murakami et al. |
| 6,954,689 | B2 | | 10/2005 | Hanson et al. |

(Continued)

OTHER PUBLICATIONS

Morey et al., U.S. Appl. No. 11/889,169, filed Aug. 9, 2007.

*Primary Examiner* — Khoi Tran
*Assistant Examiner* — Jamie Figueroa
(74) *Attorney, Agent, or Firm* — Finnegan, Henderson, Farabow, Garrett & Dunner LLP

(57) ABSTRACT

A method for enhancing productivity for an excavating operation is disclosed. The method includes establishing a machine-to-machine communication system for a fleet of machines, including at least two machines. The method also includes removing material during the excavating operation with at least a first machine of the fleet of machines. The method additionally includes operating a second machine of the fleet of machines in a mode involving contact between at least the first machine and the second machine. The method further includes employing the machine-to-machine communication system to effect controlled contact between at least the first machine and the second machine.

26 Claims, 6 Drawing Sheets

U.S. PATENT DOCUMENTS

| | | | | |
|---|---|---|---|---|
| 6,988,591 | B2 | 1/2006 | Uranaka et al. | |
| 7,222,051 | B2 | 5/2007 | Shibata et al. | |
| 7,693,633 | B2 * | 4/2010 | Donnelli et al. | 701/50 |
| 7,831,345 | B2 * | 11/2010 | Heino et al. | 701/23 |
| 2003/0234512 | A1 * | 12/2003 | Holub | 280/432 |
| 2004/0040792 | A1 | 3/2004 | Uranaka et al. | |
| 2005/0230163 | A1 * | 10/2005 | Cunningham | 180/89.1 |
| 2006/0047418 | A1 | 3/2006 | Metzler et al. | |
| 2006/0090379 | A1 * | 5/2006 | Furem | 37/443 |
| 2006/0150584 | A1 * | 7/2006 | Weiss | 54/10 |
| 2006/0155449 | A1 | 7/2006 | Dammann | |
| 2006/0229804 | A1 * | 10/2006 | Schmidt et al. | 701/205 |
| 2007/0005209 | A1 | 1/2007 | Fitzner et al. | |
| 2007/0073457 | A1 | 3/2007 | Lee | |
| 2007/0078579 | A1 | 4/2007 | Schricker et al. | |
| 2007/0088482 | A1 | 4/2007 | Mailer | |
| 2007/0124000 | A1 | 5/2007 | Moughler et al. | |
| 2007/0124050 | A1 * | 5/2007 | Donnelli et al. | 701/50 |
| 2007/0129869 | A1 | 6/2007 | Gudat et al. | |
| 2007/0175198 | A1 * | 8/2007 | Viaud et al. | 56/341 |
| 2007/0194557 | A1 * | 8/2007 | Caporali et al. | 280/493 |
| 2008/0127531 | A1 * | 6/2008 | Stanek et al. | 37/443 |
| 2008/0155866 | A1 | 7/2008 | Congdon et al. | |
| 2009/0043460 | A1 | 2/2009 | Morey et al. | |

* cited by examiner

EXCAVATING SYSTEM UTILIZING MACHINE-TO-MACHINE COMMUNICATION

TECHNICAL FIELD

The present disclosure is directed an excavating system, and more particularly, to enhancing productivity for an excavating operation.

BACKGROUND

Machines may be used to move earth, rocks, and other materials from an excavation site. Often, it may be desirable to move excavated material from an excavation site to another location sufficiently removed from the excavation site that the material must be transported some distance before being dumped. For example, the earth, rocks, and/or other materials may be loaded onto an off-highway haulage unit that may, in turn, transport the materials to a dump site. As another example, the material may be excavated by a pull pan drawn behind a tractor, and then hauled, via the pull pan, to the dump site. As a further example, a wheel tractor scraper may be used for excavating, hauling, and dumping the excavated material.

A wheel tractor scraper may be used in an operating cycle to cut material from one location during a load phase, transport the cut material to another location during a haul phase, unload the cut material during a dump phase, and return to an excavation site during a return phase to repeat the operating cycle. Depending on the nature of the operation, a fleet of machines may be employed. Several wheel tractor scrapers may be involved in an excavating operation, with, for example, one machine hauling material to a dump location, another machine traveling from the dump location to the excavating site, and still another machine in the process of loading material at the excavating site.

It may require a substantial amount of power for a wheel tractor scraper to accomplish the load phase of an operating cycle. To that end, wheel tractor scrapers may be powerfully constructed, sometimes with multiple engines. Even so, wheel tractor scrapers are sometimes assisted during the load phase by another machine. For example, wheel tractor scrapers may operate in what is generally known as the "push/pull" mode or configuration, wherein a front machine is pushed by a trailing machine, and then the loaded front machine pulls the trailing machine to assist loading the trailing machine. As another example, a wheel tractor scraper may be pushed during the load phase by a track-type tractor.

In situations where multiple machines are employed in an operation, e.g., an excavating operation, the productivity of a machine and/or a fleet of machines may depend on how well one machine coordinates with other machines involved in the operation. For example, where individual machines of a fleet are operating in series to load, haul, dump, and return, efficiency and productivity may be affected by bunching of machines and resulting downtime for a given machine or machines while waiting on another machine to proceed. In addition, where one machine assists another machine in loading, for example in the push/pull mode, or when a wheel tractor scraper is pushed by a track-type tractor or another wheel tractor scraper, contact, and direct interaction while in contact, of massive and/or powerful machines may readily lead to one machine damaging another. In addition, repeated jolting contact may cause significant operator stress.

Systems have been designed with a view toward providing a communication system for multiple machines at a worksite. For example, U.S. Patent Application Publication No. 2007/0129869 A1, published on Jun. 7, 2007 ("the '869 publication"), discloses a system for autonomous cooperative control of multiple machines. The '869 publication discloses a system whereby a host machine, assigned a particular task, may broadcast a request for assistance to other machines of a fleet of machines. A machine of the fleet may then communicate to the host machine an ability or inability to provide the requested assistance. The '869 publication alludes to a situation wherein a machine may be assigned a task simply requiring two machines working in tandem, such as push-loading a scraper.

While the system of the '869 publication may provide a degree of communication among machines of a fleet and enable a degree of autonomous operation of the machines, the '869 publication does not employ a machine-to-machine communication system that effects controlled contact between two machines. The system of the '869 publication may enable sufficient communication to make available an assisting machine for push-loading a scraper, but the inherent risks of contact between the two machines may remain, and overall productivity may be compromised by machine damage and/or increased operator fatigue due, for example, to the great care operators must exercise during contact.

The present disclosure is directed to one or more improvements in the existing technology.

SUMMARY OF THE INVENTION

In one aspect, the present disclosure is directed to a method for enhancing productivity for an excavating operation. The method includes establishing a machine-to-machine communication system for a fleet of machines, including at least two machines. The method also includes removing material during the excavating operation with at least a first machine of the fleet of machines. The method additionally includes operating a second machine of the fleet of machines in a mode involving contact between at least the first machine and the second machine. The method further includes employing the machine-to-machine communication system to effect controlled contact between at least the first machine and the second machine.

In another aspect, the present disclosure is directed to a system for enhancing productivity for an excavating operation. The system includes a fleet of mobiles machines, including at least two machines, a first of the at least two machines configured to remove material during the excavating operation, and the at least two machines configured to operate in a mode involving contact between the at least two machines during the excavating operation. The system further includes a machine-to-machine communication system configured to provide communication between the at least two machines of the fleet of machines and effect controlled contact between at least the first machine and a second machine of the at least two machines.

DETAILED DESCRIPTION

Figure 1:
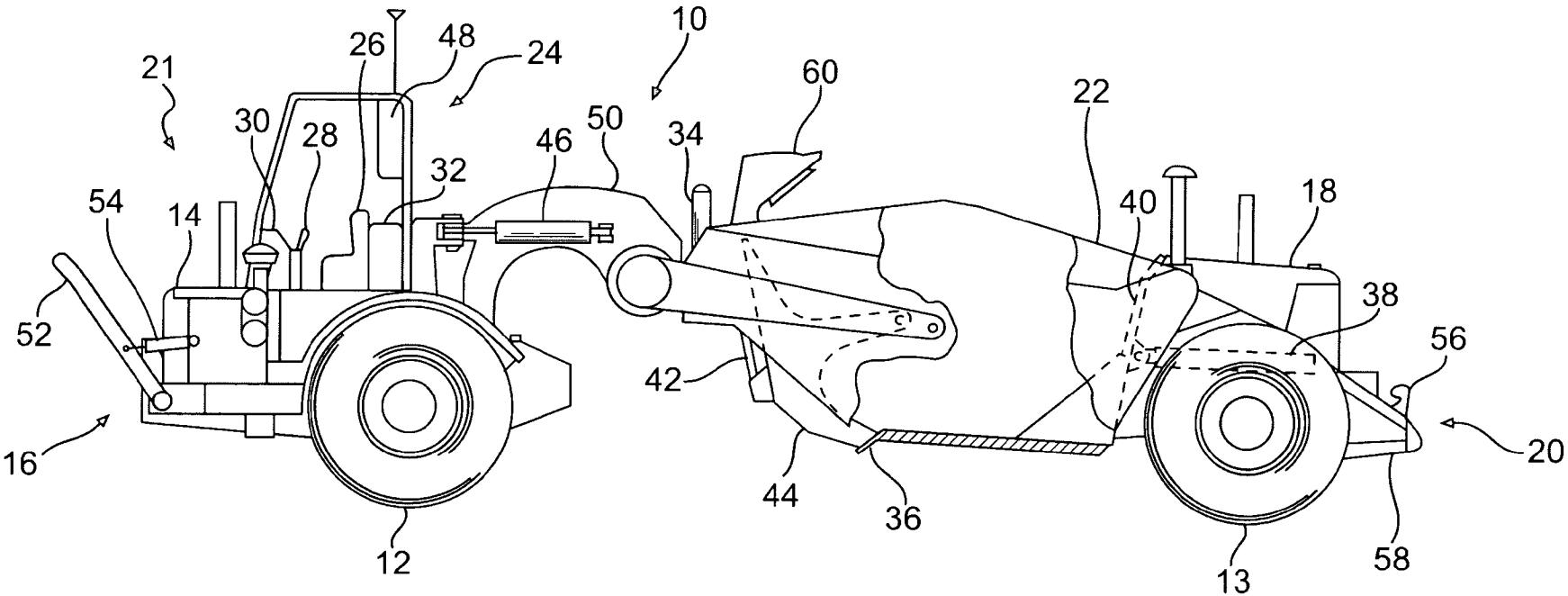
FIG. 1 is a diagrammatic illustration of a machine according to an exemplary disclosed embodiment.

FIG. 1 diagrammatically illustrates one exemplary embodiment of a machine 10 which may be, for example, a wheel tractor scraper. It will be understood that machine 10 may include various machines that may be characterized as wheel tractor scrapers, pull-pans, etc. Machine 10 may include one or more traction devices, such as front wheels 12 and rear wheels 13, enabling the machine to function as a mobile unit. A suitable power source 14, e.g., a diesel engine, may be located at the front 16 of the machine 10, and may drive the front wheels 12. An additional power source 18, which also may be a diesel engine, may be included at the rear 20 of the machine 10. The portion of machine 10 including power source 14 and front wheels 12 may be referred to as a front traction unit 21.

A payload carrier 22 may be located intermediate the front traction unit 21 and rear 20 of the machine 10, and may be connected to the front traction unit 21 through a structural member 50, generally referred to as a gooseneck. Payload carrier 22 may enable the machine 10 to transport a quantity of material, such as earth. Payload carrier 22 may include a ground engaging tool 36, an apron 44 configured to move between an open position during loading and unloading, and a closed position during hauling, and an ejector 40, configured to assist in dumping a load. A camera 60 may be associated with the payload carrier and strategically mounted so as to view or detect when the payload carrier 22 is loaded, for example. Camera 60 also may enable determination of the amount of material loaded and/or the speed with which material is loaded. Payload carrier 22 optionally may include various mechanisms to assist loading material into payload carrier 22. For example, payload carrier 22 may include an auger mechanism including one or more augers (not shown), or an elevator mechanism (not shown) suitably mounted adjacent the entrance to payload carrier 22.

Machine 10 may further include an operator station 24 which may be associated, for example, with front traction unit 21. Operator station 24 may include an enclosed or partially enclosed cab, and may include an operator seat 26, suitable operator control devices 28, and a display device 30. Machine 10 also may include a suitable control system, including a controller 32, various detectors or sensors, and various actuators for operating the several components associated with the machine. For example, machine 10 may include one or more actuators 34, e.g., hydraulic cylinders, for raising and lowering the payload carrier 22. The one or more actuators 34 may lower payload carrier 22 such that ground engaging tool 36 may penetrate material to be loaded during a load phase of the machine 10, and may raise the payload carrier 22 for transportation of the payload during a haul phase of machine 10.

Additional actuators may include actuator(s) 38 for moving the ejector 40 during a dump phase, and actuator(s) 42 for controlling the apron 44. The actuator(s) 38 for ejector 40 and actuator(s) 42 for apron 44 may operate synchronously during a dump phase, with actuator(s) 42 moving apron 44 to an open position and actuator(s) 38 moving ejector 40 within payload carrier 22 to assist in dumping the payload through the opening formed at the front of the payload carrier 22. Steering of machine 10 may be facilitated by a steering unit including one or more actuators 46 located, for example, at a position between the payload carrier 22 and the front 16 of machine 10.

As diagrammatically illustrated in the exemplary embodiment of FIG. 1, a machine-to-machine communication system 48 may be associated with machine 10. In FIG. 1, machine-to-machine communication system 48 is illustrated as associated with operator station 24. However, it will be understood (and described in more detail below) that machine-to-machine communication system 48 may be, in fact, a system of components that enable machine 10 to communicate with other machines of a fleet of machines. Machine-to-machine communication system 48, as illustrated diagrammatically in FIG. 1, may include those components of the communication system that enable machine 10 to receive and send signals, and that communicate with controller 32 and/or display device 30, for example. In exemplary embodiments, controller 32 and/or display device 30 may be considered components of the machine-to-machine communication system 48.

Figure 2:
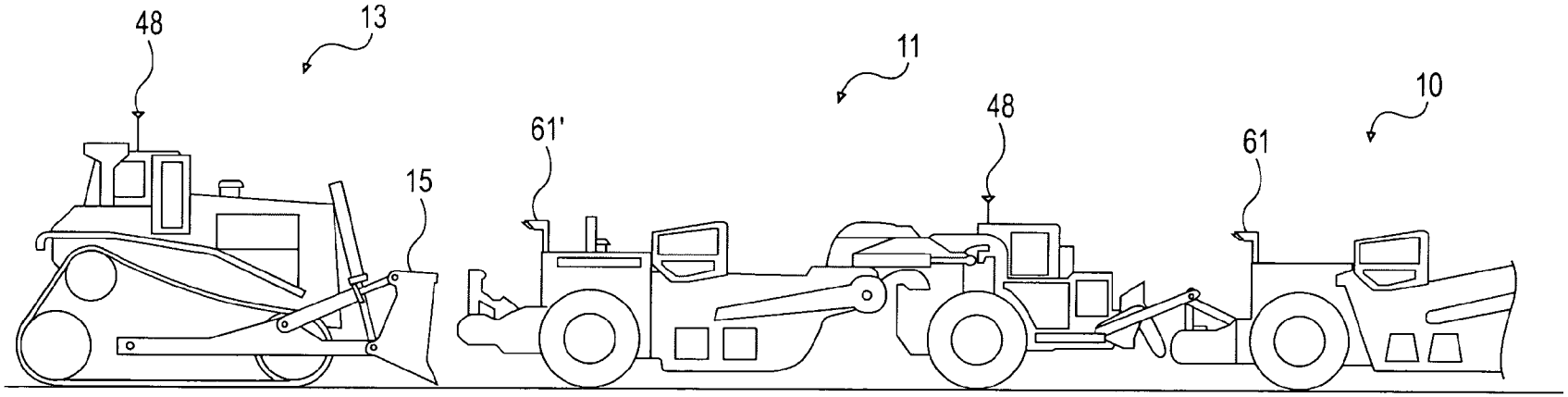
FIG. 2 is a diagrammatic illustration of an exemplary embodiment of an association of machines.

It is sometimes expedient that plural machine may interact, one with the other, during an operation. At times such interaction may involve contact between machines. For example, a wheel tractor scraper may be push loaded by a track-type tractor or by another wheel tractor scraper. In some arrangements, more than one track-type tractor may be employed to push a wheel tractor scraper to assist loading. As another example, it is at times expedient that loading a machine may involve multiple machines working in what is sometimes referred to in the art as push/pull mode or configuration. For example, FIG. 2 diagrammatically illustrates an association of machines, including two wheel tractor scrapers 10 and 11, which may operate in a push/pull mode, and a track-type tractor 13, which may be employed to push a wheel tractor scraper. Additionally, several machines may work in series, with a first machine pushed by a second machine for loading the first machine, the second machine then pulled by the first (loaded) machine to load the second machine, and a third machine being pulled by both the first and second loaded machines, or by the second loaded machine alone. Other multiple machine configurations are contemplated.

Referring to FIG. 2, machine 10 may encounter material and/or conditions of a character that render loading machine 10 more feasible and/or efficient if machine 10 is pushed by another machine. For example, machine 10, a wheel tractor scraper, may be pushed by machine 11 which, in the exemplary embodiment illustrated, also is a wheel tractor scraper. In a push/pull mode of operation, machine 11 may then be pulled by machine 10 in order to assist loading of machine 11. Alternatively, or in addition, machine 11 may be assisted in its loading process by a third machine 13 which is, in the exemplary embodiment shown in FIG. 2, a track-type tractor. In the example in FIG. 2, third machine 13 includes a blade assembly 15 configured to contact the rear of machine 11, and is illustrated in a position approaching machine 11.

The contact association between machine 10 and machine 11 may be observed/detected via, for example, a camera 61, strategically mounted on machine 10 so as to provide a view of the contact region between machines 10 and 11. The contact association between machine 11 and machine 13 may be observed/detected via, for example, a camera 61', strategically mounted on machine 11 so as to provide a view of the contact region between machines 11 and 13. Machines 10, 11, and 13 each may communicate with one another, and with other machines of a fleet of machines, via machine-to machine communication system 48, illustrated diagrammatically as associated with each machine (not visible on machine 10 in FIG. 2, but illustrated in FIG. 1).

Figure 3:
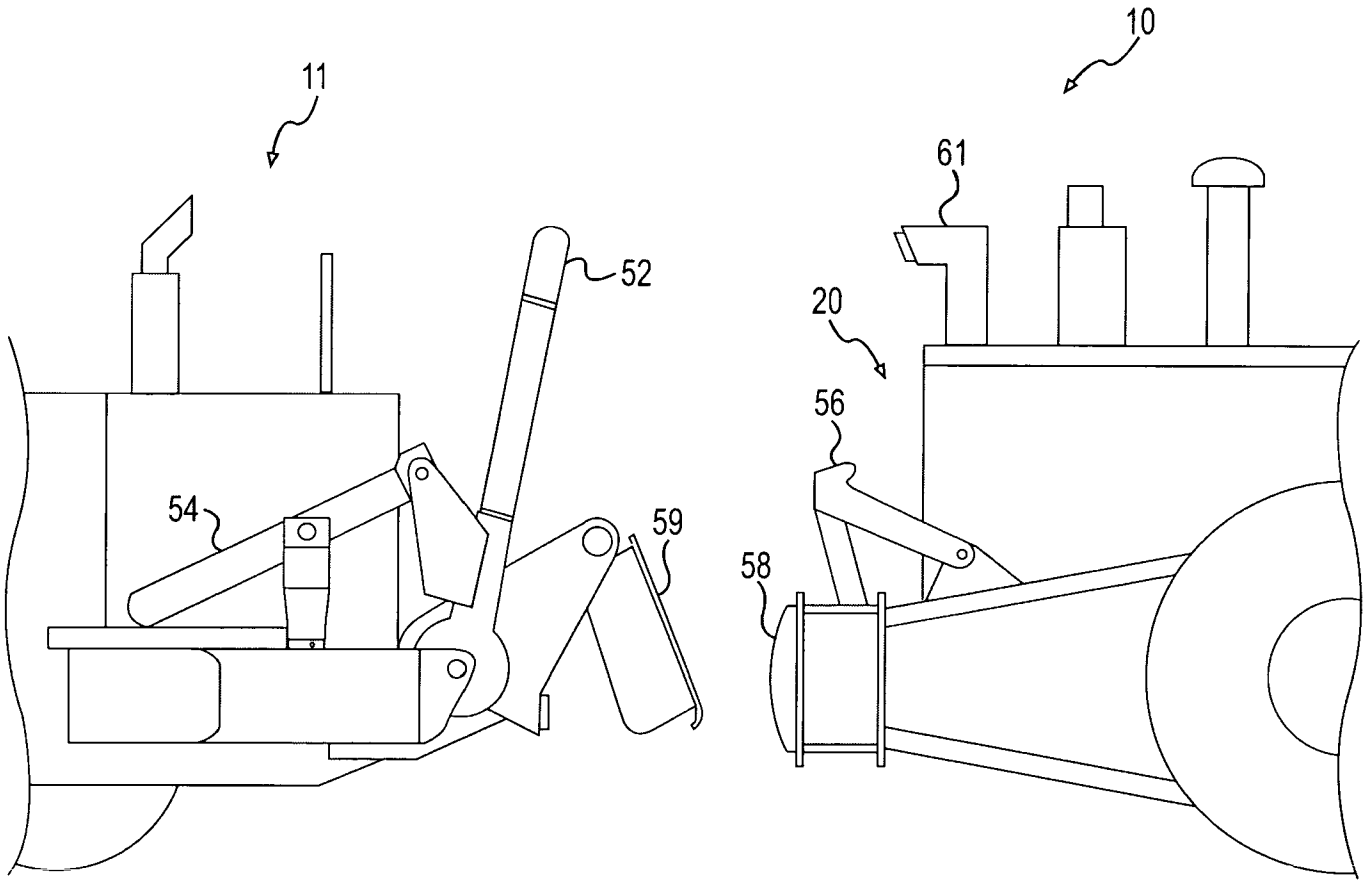
FIG. 3 is a schematic illustration showing details of two machines configured to operate in a push/pull configuration

FIG. 3 diagrammatically illustrates an exemplary embodiment of some of the elements involved in enabling two wheel tractor scrapers to operate in a push/pull mode. Referring to FIG. 3, the rear portion 20 of machine 10, which in this example may be designated a first machine, may include rear push block 58 and hook mechanism 56. Another machine 11, which in this example may be designated a second machine, may include front push block 59 and bail mechanism 52. An actuator 54 may be suitably mounted on machine 11 and configured to deploy bail mechanism 52 to a position of engagement with hook mechanism 56 of machine 10, enabling machine 10 to pull machine 11. Machine 11 may be employed to push machine 10 by suitable manipulation of machine 11 relative to machine 10 so that front push block 59 is maneuvered to a position of engagement with rear push block 58 of machine 10.

Various technologies may be employed to sense or detect parameters and conditions associated with machine 10, or associated with machine 10 in cooperative relationship to other machines of a fleet of machines. It may be desirable to ascertain with a degree of precision the relative positions of two machines, such as machine 10 and machine 11 (FIG. 3), or each of machines 10, 11, and 13 (FIG. 2), when initiating and/or terminating operation in a push/pull mode, or pushing by a track-type tractor, for example. To that end, one or more of GPS, radar, and/or satellite vision technologies may be employed to monitor the positions of at least first machine 10, second machine 11, and third machine 13. In illustrated exemplary embodiments, camera 61 may be strategically mounted on the rear portion 20 of machine 10, for example on a mast or stalk, so as to yield a view of the interaction between bail mechanism 52 and hook mechanism 56, the interaction between front push block 59 and rear push block 58, and the approach and departure of one machine relative to the other. Camera 61' (not shown in FIG. 3) similarly may be located on machine 11. It will be understood that, while cameras 61 and 61' have been illustrated at the rear of a machine, it is contemplated that cameras could be mounted at the front of a machine and provide an appropriate view of the machine contact area.

Camera 61 may provide controller 32 with instantaneous signals indicating the speed of approach of a second machine 11 to a first machine 10, for example. Additionally, camera 61 may enable an accurate determination of when bail mechanism 52 should be deployed into engagement with hook mechanism 56, and may enable an accurate determination of when bail mechanism 52 lifts from engagement with hook mechanism 56. For example, an accurate indication of when the bail mechanism 52 is clear of hook mechanism 56 may enable the machine 10 to more reliably enter the haul phase of the operation without delay. Controller 32 may receive and process signals from camera 61 and generate signals to initiate machine action responsive to the received and processed signals. For example, machine 10 may be controlled via controller 32 to initiate a haul phase in response to a signal from camera 61 indicating that bail mechanism 52 is clear of hook mechanism 56.

Controller 32 may include a central processing unit, a suitable memory component, various input/output peripherals, and other components typically associated with machine controllers. Controller 32 may include programs, algorithms, data maps, etc., associated with operation of machine 10. Controller 32 may be configured to receive information from multiple sources, such as, for example, one or more of the actuators 34, 38, 42, 46, and 54, cameras 60, 61, 61', etc., various sensors or detectors (e.g., for machine travel direction, ground speed, engine operation, etc.), as well as input from a machine operator via, for example, control devices 28. Controller 32 may be suitably located to send and receive appropriate signals to and/or from the various sensors, actuators, etc., associated with machine 10.

Figure 4:
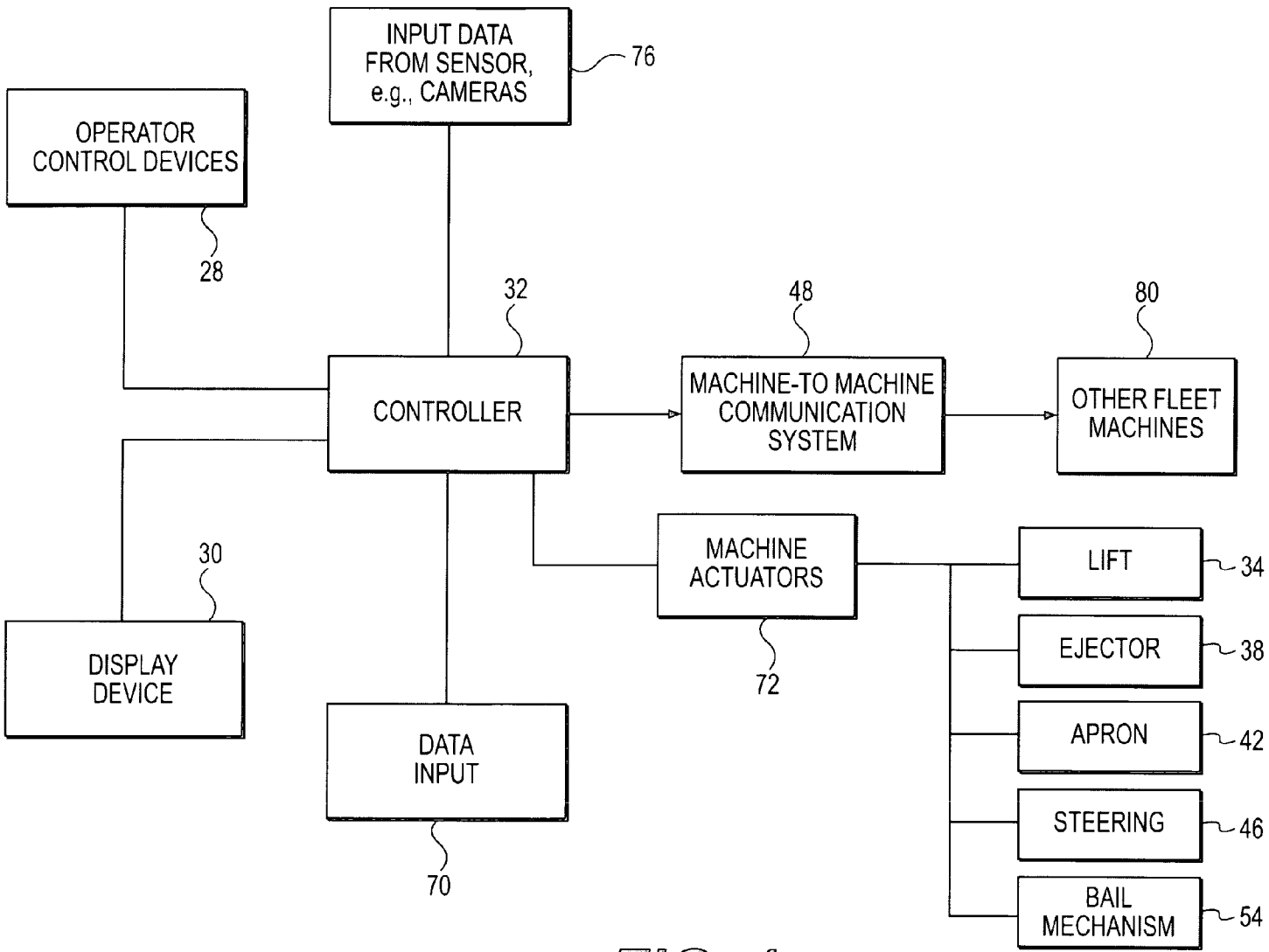
FIG. 4 is a diagram of an exemplary control system.

An exemplary control system 68 for machine 10 is schematically illustrated in FIG. 4. Referring to FIG. 4, controller 32 may suitably communicate with various machine components, for example via conductors, and may suitable interface with the machine-to-machine communication system 48, which may enable communication with other fleet machines, indicated generally at 80. Operator control devices 28 and display device 30 (which may be a touch screen display device, for example) may enable an operator to manually supply signals to controller 32, and display device 30 may, for example, provide an operator with various information to enhance operator awareness of various machine systems, provide images from cameras 60, 61, 61', etc., and otherwise visually apprise an operator of information associated with machine operation. Controller 32 may receive data input 70 via various sources, including keyboards, a touch screen display (which may be the touch screen display associated with display device 30, for example), computer discs, or other sources of data input known to those skilled in the art.

Controller 32 also may communicate with various machine actuators 72, including for example, the lift actuator(s) 34, ejector actuators(s) 38, apron actuator(s) 42, steering actuator (s) 46, and bail mechanism actuator(s) 54, and any other actuators associated with machine 10. Controller 32 also may communicate with various engine speed control expedients, transmission gear shifting expedients, etc. Input data from sensors, generally indicated at 76, may be communicated to controller 32, for example on an on-going basis. This may enable relatively continual updating of programs and/or algorithms employed for controlling machine 10. For example, controller 32 may receive data from cameras 60, 61, 61', etc., and/or various other sensors, detectors, diagnostic devices, etc., that may be employed to gather data relevant to machine operation.

INDUSTRIAL APPLICABILITY

The disclosed method and system may be applicable to various machines which may function cooperatively in a fleet of machine that includes two or more machines. For example, where one or more wheel tractor scrapers operate in a contact mode with another wheel tractor scraper or a track type tractor, the disclosed method and system may enable an efficiency of operation otherwise unattainable. The disclosed machine-to-machine communication system may facilitate the operators of two machines operating in a contact mode to accomplish controlled contact and disengagement. In addition, a single operator may control the contact mode operation of two or more machines. Furthermore, two or more machines may operate autonomously, for example where the excavating site may include hazardous material.

Figure 5:
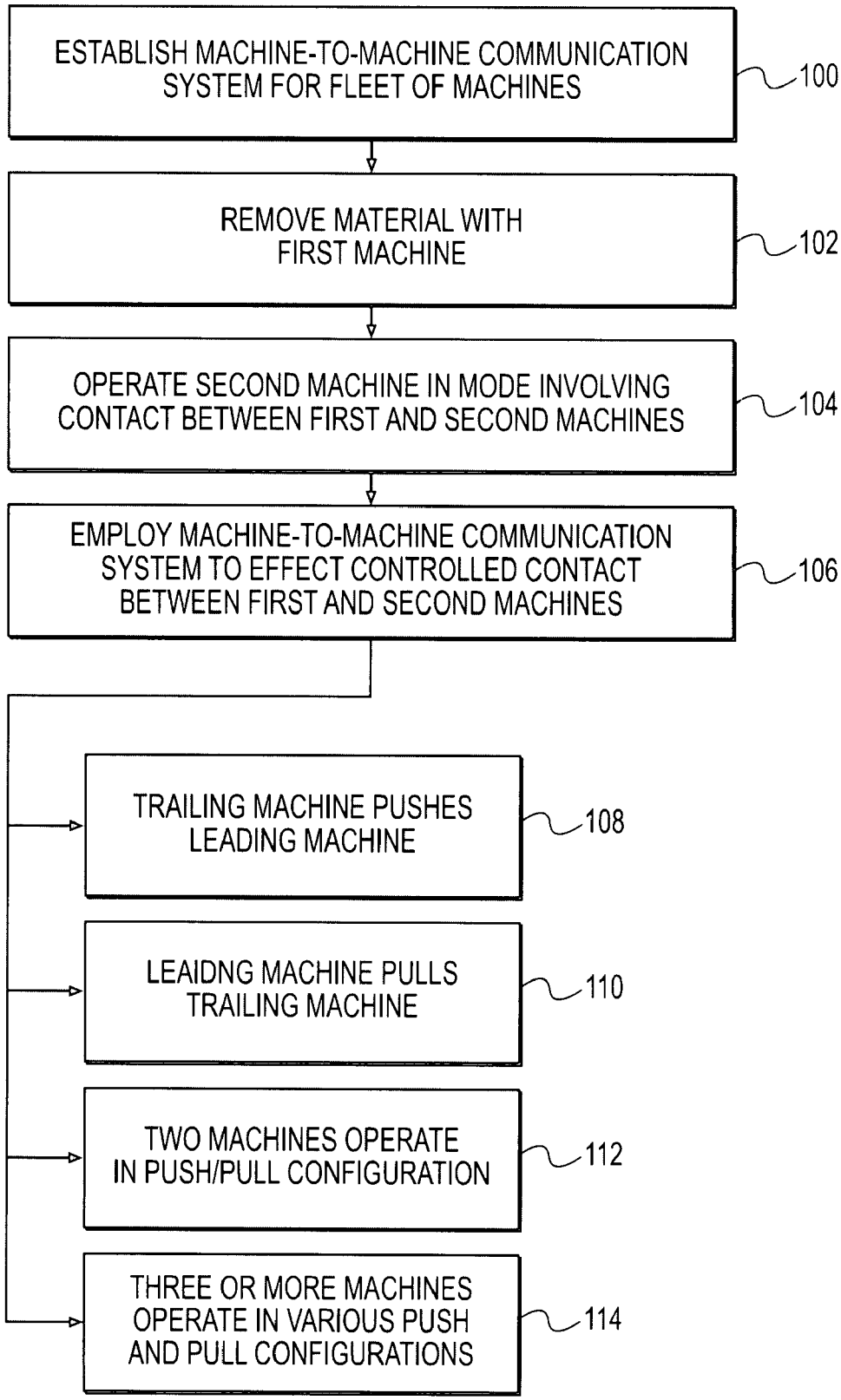
FIG. 5 is a block diagram representation of a system and method according to an exemplary disclosed embodiment.

FIG. 5 diagrammatically and schematically illustrates various aspects that typically may be involved in systems and methods in accordance with exemplary embodiments of the disclosure. It should be noted that, of the various items set forth in FIG. 5, all may not necessarily be present in a given operation involving machine-to-machine communication. For example, the disclosure contemplates systems and methods with various combinations of machines operating in a contact mode. In addition, the sequence of the various indicated items may vary, depending, for example, on the particular work site involved, the types of machines employed, etc.

Referring to FIG. 5, a machine-to-machine communication system is established, at 100, for a fleet of machines that may be employed in a particular operation. For example, it is contemplated that, on a smaller scale operation, two machines may be employed, one being a wheel tractor scraper, and the other being either a track-type tractor or another wheel tractor scraper. For larger scale operations, there may be a substantial number of machines in the fleet, including multiple wheel tractor scrapers and track-type tractors. The communication system may entail various technologies, including, for example, wireless communication systems involving satellite, cellular, infrared, and/or any other type of wireless communications that enable machines to wirelessly communicate. The communication system also may include various strategically located cameras, radar technology, etc., which may provide views of, or otherwise detect, approaching machines and machine movements before, during, and after contact.

Once a machine-to-machine communication system has been established and a desired fleet of machines assembled, the excavating operation may begin, or continue, with the machine-to-machine communication system implemented. A first machine may remove material, at 102. For example, a wheel tractor scraper may proceed forward to load material from the site to be excavated. At times, and in some conditions, the material to be excavated may be of such character, and/or the machine may be of sufficient power, that the machine may be able to load material to an optimum payload level on its own power. At other times, and under certain conditions, the material to be excavated may be of such character and/or the machine may lack sufficient power such that the machine may not be able to load material to an optimum payload level without the assistance of another machine.

When, for example, a first machine is unable to self-load to optimum payload, or when it becomes desirable for any reason to provide the first machine with assistance in loading, a second machine of the fleet may be operated in a mode involving contact between the first machine and the second machine, at 104. For example, when the first machine is a wheel tractor scraper, a second machine, for example, a track-type tractor, may be employed to maneuver to a position behind the first machine, engage a blade mechanism of the track-type tractor with the rear portion of the wheel tractor scraper, and employ the power and traction of the track-type tractor to push load the wheel tractor scraper. In lieu of the second machine being a track-type tractor, the second machine may be a second wheel tractor scraper, for example.

Control of the position of machines of a fleet of machine, such as, for example, a wheel tractor scraper being approached by another machine for subsequent pushing of the wheel tractor scraper by the other machine, may be effected by various technologies. For example, global positioning system (GPS) technology, radar technology, or other types of locating technology may be employed. It should be readily apparent to those skilled in the art that, employing such locating technology, the relative positions of machines of the fleet may be ascertained with a relatively high degree of accuracy.

As a second machine approaches a first machine to make contact, the machine-to-machine communication system may be employed to effect controlled contact between the first machine and the second machine, at 106. Wheel tractor scrapers and track-type tractors may be robust, massive machines, and may possess substantial power. Contact between such machines may be difficult to control. Uncontrolled contact between machines of substantial power and tonnage may cause great machine stress, and may cause stress to machine operators. Employing the machine-to-machine communication system, machine contact can be controlled to a degree otherwise unattainable. For example, by monitoring the approaching contact of a second machine against the rear portion of a first machine, the contact between machines can be controlled with accuracy and precision.

In exemplary embodiments, the aspects of approach, contact, and separation of two machines may be monitored by a suitable camera 61, 61', etc., mounted at the rear of a machine and affording a comprehensive view of the machine contact area. Also, multiple cameras may be employed where desirable or where advantageous for a better view. A camera or cameras may be located at the front of an approaching machine to provide a view of the contact area, in addition to or in lieu of a rear mounted camera or cameras on the leading machine. Signals from camera 61, 61', etc., may provide a suitable image or other indication on display device 30 to apprise an operator of one or more of the contacting machines of events at the contact area, or signals may be provided to controller 32, enabling autonomous operation of one or more of the contacting machines. In addition, an audible sound adjacent the operator station (e.g., operator station 24) of one or more of the contacting machines may occur just before contact is made between the machines in order to ensure that the machine operators may be prepared for the contact and/or machine connection. For example, an audible sound may be made by a horn, bell, etc., and may conveniently be configured so that it may be turned on or off by an operator.

Purposeful machine contact may be manifested in various ways. In the context of an excavating operation, machine contact often may occur where it is desired to have a trailing machine push a leading machine, at 108. For example, the machine-to-machine communication system may be employed to facilitate controlled contact between a leading wheel tractor scraper and either a track type tractor or another wheel tractor scraper pushing the wheel tractor scraper to assist loading of the leading wheel tractor scraper. Machine contact may occur where it is desired to have a leading machine pull a trailing machine, at 110. Two machines may be employed together in a push/pull configuration, at 112, between two wheel tractor scrapers, for example. Three or more machines may be operated in controlled contact mode in various configurations wherein one or more machines pull or push another machine or machines, at 114.

Figure 6:
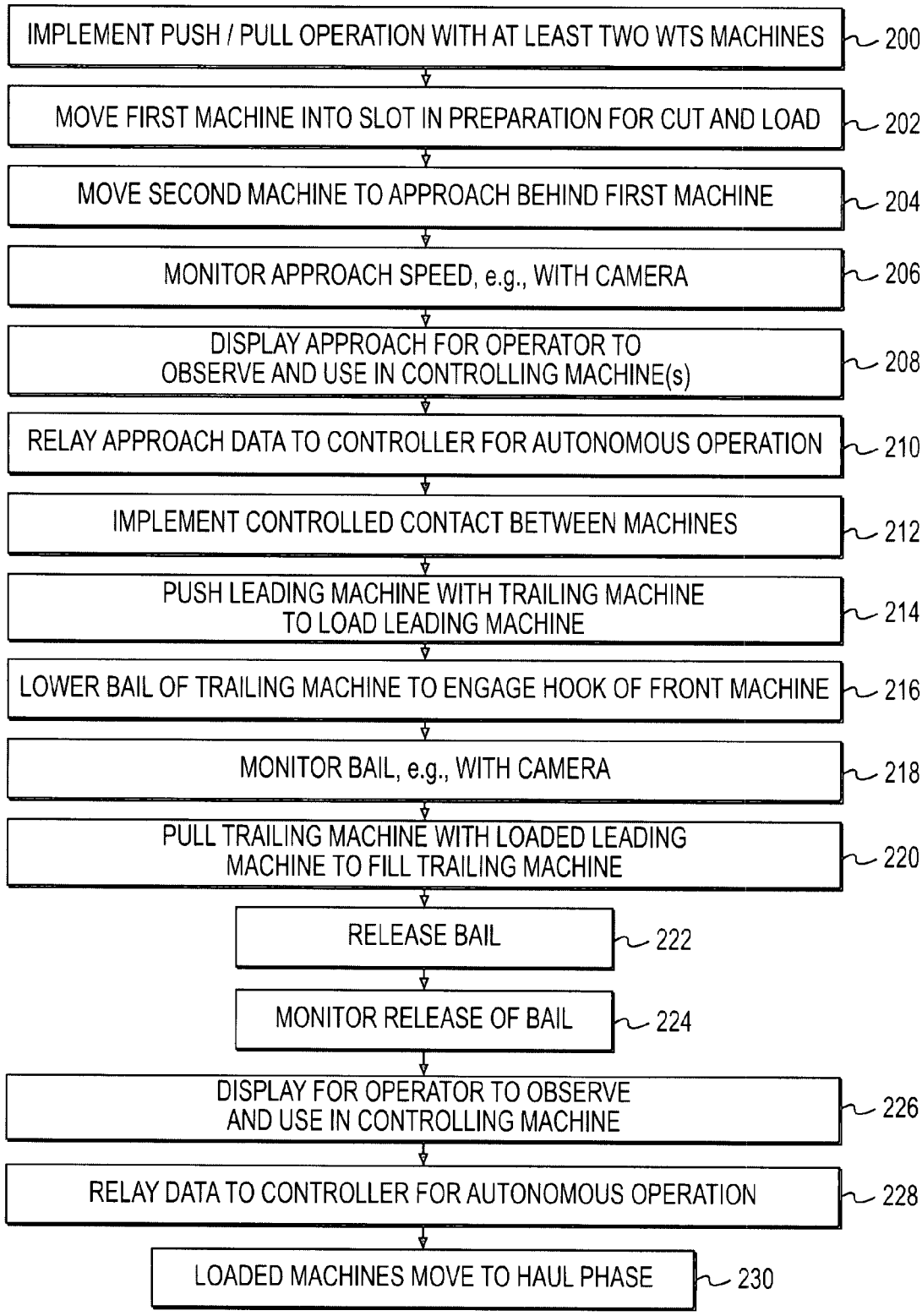
FIG. 6 is a block diagram illustrating exemplary aspects of a push/pull operation.

FIG. 6 diagrammatically and schematically illustrates an exemplary embodiment implementing a machine-to-machine communication system in the context of two machines operating in a push/pull mode. In the push/pull mode of operation, a leading machine may be pushed by a trailing machine in order to assist loading of the leading machine, then the leading machine may pull the trailing machine to assist its loading. It should be noted that, of the various items set forth in FIG. 6, all may not necessarily be present in a given push/pull operation involving machine-to-machine communication. In addition, the sequence of the various indicated items may vary, depending, for example, on the particular work site involved, the types of machines employed, etc.

In the exemplary embodiment, a push/pull operation is implemented with at least two machines at 200. During an excavating operation, a first machine (e.g., machine 10), which may be designated the leading machine, is moved into the "slot" (the particular location from which material is to be cut and loaded) in preparation for loading, at 202. A second machine (e.g., machine 11), which may be designated the trailing machine, is moved into position approaching the rear of the leading machine, at 204. As the trailing machine approaches the rear of the leading machine, a camera, such as camera 61, may monitor the approach speed and position of the trailing machine, at 206. The results may be displayed, for example at display device 30 of either or both machines, for an operator of either or both machines to observe, at 208. Signals from the camera also may be relayed to controller 32 and employed in autonomous machine operation, at 210. It will be understood that in lieu of camera 61, suitable radar or other technology may be employed.

At 212, the trailing machine may be operated to implement controlled contact as it approaches and contacts the leading machine. Either or both of the leading and trailing machines, in response to signals from camera 61, for example, may be slowed and otherwise manipulated to provide the controlled contact. For example, the controller 32 of each machine may, via the machine-to-machine communication system, ensure that the relative speeds of the two machines are controlled so that controlled contact is achieved. In addition, or alternatively, an operator of one or both machines may be apprised of images and/or data associated with the machine contact area via, for example, display 30.

At 214, the trailing machine pushes the leading machine to assist loading the payload carrier 22 of the leading machine. With the added power and traction from the pushing contact of the trailing machine, the leading machine may reach a desired payload, which may be detected, for example, by camera 60. At this point, in a push/pull operation, the leading machine may now assist the trailing machine in its loading phase. The bail mechanism 52 of the trailing machine may be lowered to engage the hook mechanism 56 of the leading machine at 216. Movement of bail mechanism 52 for engagement with hook mechanism 56 may be monitored, for example, with the aid of camera 61, at 218.

Once bail mechanism 54 of the trailing machine is engaged with hook mechanism 56 of the leading machine, the added traction and power of the loaded leading machine may be employed to pull the trailing machine and assist it in the loading process, at 220. After the trailing machine is loaded, as detected by camera 60 of the trailing machine, for example, actuator 54 may release the bail mechanism 52 from hook mechanism 56, at 222. The release of bail mechanism 52 may be monitored via camera 61, for example, at 224, with display of data from camera 61 at display device 30, at 226, for operator observation and use in machine control and/or for control of one or both machines autonomously, at 228, based on signals from camera 61, for example. The leading machine may then accelerate and move into a haul phase, with the trailing machine itself then moving into a haul phase.

It will be apparent that, based on the disclosed machine-to-machine communication system for controlled machine contact, various machine arrangements facilitating optimum productivity with minimized risk of machine damage may be effected. For example, it is sometimes expedient to push a first machine with a second machine in order load the first machine, and then pull the second machine with the first machine to load the second machine. A third machine may then be pulled by both of the loaded first and second machine. In such an arrangement, damage to the goose neck structure of the third machine (a wheel tractor scraper) may be avoided by employing the second machine to push the first machine, then employing the third machine to push the second machine, which in turn then pulls the third machine for loading. With the disclosed machine-to-machine communication system, the three machines may be employed with reduced risk of machine damage and maximized productivity. For example, it may be ensured that timing of release of engagement between the first and second machines may be efficiently coordinated with engagement between the second and third machines to avoid damage, for example to the goose neck structure of the third machine.

A track-type tractor machine may be employed to push a wheel tractor scraper with reduced risk of machine damage. In situations where it is expedient to employ a track-type tractor to push a wheel tractor scraper for loading, it sometimes occurs that a blade mechanism of the track-type tractor may cause damage to the wheel tractor scraper, for example, damage to the rear tires. In practice, either the risk of tire damage from uncontrolled contact has been tolerated, or a large cushion blade has been employed on the track-type tractor for pushing. With the disclosed machine-to-machine communication system, controlled contact can be ensured with various blade mechanisms on a track-type tractor, and proper placement of the blade for pushing can be assured, so as to avoid risk of costly tire damage, and other damage, to the wheel tractor scraper.

Implementation of the disclosed machine-to-machine communication system will facilitate controlled contact between machines. As a result, machine damage and the resulting costs may be minimized. The machine-to-machine communication system will permit efficient operation of more than one machine by a single operator. For example, an operator of the leading machine in a push/pull operation may, through the machine-to-machine communication system, control both the leading machine and the trailing machine. Similarly, an operator of the trailing machine may control both the leading and trailing machines. Furthermore, the machine-to-machine communication system may enable autonomous operation either through programming of machine controllers 32, or via control from a remote location.

In some operations, numerous machines may be employed. In the interest of optimizing productivity, it may be optimum to ensure that the several machine employed in an operation be at varying stages of an operating cycle. Bunching of machines, where one or more machines stands effectively idle while waiting for another machine to finish a load phase, may be avoided through employment of the disclosed machine-to-machine communication system. The several machines, operating at various phases of operation cycles, may be continuously updated on the status of other machine operating in the same or similar cycles. In this way, bunching may be avoided, and fuel costs may be minimized, and productivity may be optimized.

It is to be noted that the term "optimizing," and the like, is to be construed herein, not in the sense of an achieved ideal, but in the sense of a strategically targeted objective to be approached as closely as is reasonably possible. Those skilled in the art will recognize that absolute optimizing of productivity may be an elusive goal. However, the exemplary embodiments disclosed herein approach optimization of productivity, for example by use of the machine-to-machine communication system in the disclosed exemplary embodiments, to ensure controlled machine contact, minimize machine damage, minimize operator stress and fatigue, and minimize fuel, tire, and other costs.

It will be apparent to those skilled in the art that the methods and systems disclosed herein may be applicable to machines other than those generally characterized as wheel tractor scrapers. It also will be apparent to those skilled in the art that, while cameras, such as cameras 60, 61, 61', etc., have been discloses as examples of sensing, detecting, or data gathering expedients for determining payload parameters and machine proximity and contact, the disclosure is not limited to cameras. For example, it is contemplated that various other expedients, e.g., radar technology, may be employed both the determine payload parameters and to determine machine proximity and/or contact.

It will be apparent to those skilled in the art that various modifications and variations can be made to the disclosed method and system for optimizing wheel tractor scraper productivity without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A method for enhancing productivity for an excavating operation, the method comprising:

using a machine-to-machine communication system to allow a first machine and a second machine of a fleet of machines to communicate with each other;

employing the machine-to-machine communication system to send a communication relating to at least one monitored characteristic of the second machine to the first machine as the second machine approaches the first machine; and automatically controlling a speed of the first machine based on the communication in order to physically contact the first and second machines; and further including:

operating the first machine in a load phase to remove material during the excavating operation while the first and second machines are physically contacting; wherein the first machine is a first wheel tractor scraper and the speed of the first wheel tractor scraper is automatically controlled based on the communication while operating the first wheel tractor scraper in the load phase.

2. The method of claim 1, including controlling physical contact between at least the first machine and the second machine by employing one or more of GPS, radar, and satellite vision technologies to monitor the positions of at least the first machine and the second machine.

3. The method of claim 2, including controlling physical contact between more than two machines of the fleet of machines.

4. The method of claim 1, wherein the physical contact between the first and second machines includes pushing the first machine with the second machine or pulling the second machine with the first machine.

5. The method of claim 4, further including:

employing the machine-to-machine communication system to send a second communication relating to at least one monitored characteristic of a third machine, and automatically controlling a speed of the at least one of the first machine or the second machine based on the second communication in order to physically contact the second and third machines, wherein the physical contact between the second and third machines includes one of pushing the second machine with the third machine and pulling the third machine by the second machine.

6. The method of claim 1, wherein:

the second machine is one of a second wheel tractor scraper or a track-type tractor, and operating the second machine includes physically contacting and pushing the first wheel tractor scraper with one of the second wheel tractor scraper or the track-type tractor to assist the first wheel tractor scraper in the load phase.

7. The method of claim 6, including:

employing a camera to determine when the second machine completes pushing the first wheel tractor scraper; and automatically moving the first wheel tractor scraper into a haul phase responsive to determination that the second machine has completed pushing.

8. A system for enhancing productivity for an excavating operation, the system comprising:

a fleet of mobiles machines including a first machine and a second machine, the first machine being configured to remove material during the excavating operation, and the first and second machines configured to operate in a mode involving physical contact between the first and second machines during the excavating operation;

a machine-to-machine communication system configured to provide communication between the first and second machines relating to at least one monitored characteristic of the first and second machines; and at least one controller being configured to automatically control a speed of at least one of the first machine or the second machine based on the communication such that the second machine physically contacts and pushes the first machine;

the at least one controller being further configured to automatically control, based on the communication, a mechanism that engages the first machine and the second machine such that the first machine pulls the second machine.

9. The system of claim 8, wherein the at least one controller is further configured to permit an operator of one of the first machine and second machine to control an operation of both the first machine and the second machine.

10. The system of claim 8, wherein the at least one controller is further configured to autonomously control operation of both the first machine and the second machine.

11. The system of claim 10, wherein:

the first machine is a first wheel tractor scraper, and the second machine is one of a second wheel tractor scraper or a track-type tractor; and the first wheel tractor scraper includes a push block associated with a rear of the first wheel tractor scraper and configured to cooperate with the one of the second wheel tractor scraper or the track-type tractor, and facilitate pushing the first wheel tractor scraper.

12. The system of claim 11, wherein:

the second machine is a second wheel tractor scraper including a push block associated with the rear of the second wheel tractor scraper;

the mechanism that engages the first machine and the second machine includes:

one of a hook mechanism or a bail mechanism associated with the rear of the first wheel tractor scraper, and the other one of the hook mechanism or the bail mechanism associated with the second wheel tractor scraper; and the at least one controller is configured to autonomously control engagement between the hook mechanism and the bail mechanism.

13. A machine configured to load and transport a quantity of material, the machine being one of a fleet of machines, the machine comprising:

an element configured to enable the machine to physically contact and exert a force on an additional machine of the fleet of machines;

a machine-to-machine communication system configured to enable communication between the machine and the additional machine, the communication relating to at least one monitored characteristic of the additional machine as the additional machine approaches the machine; and a controller configured to automatically control a speed of the machine based on the communication in order to physically contact the machine and the additional machine; wherein the machine is a wheel tractor scraper.

14. The machine of claim 13, wherein the wheel tractor scraper includes:

front and rear ground supporting units;

a payload carrier intermediate the front and rear ground supporting units;

a steering unit for steering the wheel tractor scraper during transport of loaded material;

at least one power unit for delivering power to the wheel tractor scraper;

a bail mechanism associated with the front of the wheel tractor scraper and configured to cooperate with one of the additional machine or another machine of the fleet of machines to facilitate pulling the wheel tractor scraper; and a push block and a hook mechanism associated with the rear of the wheel tractor scraper and configured to cooperate with one of the additional machine or another machine of the fleet of machines to facilitate at least one of pushing the wheel tractor scraper and pulling the wheel tractor scraper.

15. The machine of claim 13, further including a camera mounted adjacent a rear portion of the machine and positioned to detect when contact exists between the machine and the additional machine and when contact between the machine and the additional machine ceases.

16. The method of claim 1, wherein automatically controlling the speed of the first machine includes limiting the speed of the first machine.

17. The method of claim 1, further including:

employing the machine-to-machine communication system to send a second communication relating to at least one monitored characteristic of the first machine to the second machine as the second machine approaches the first machine; and automatically controlling a speed of the second machine based on the second communication in order to physically contact the first and second machines.

18. The method of claim 5, further including:

employing the machine-to-machine communication system to send a third communication relating to the at least one monitored characteristic of the second machine to the third machine as the third machine approaches the second machine; and automatically controlling a speed of the third machine based on the third communication in order to physically contact the second and third machines.

19. The method of claim 5, wherein automatically controlling the speed of the at least one of the first machine or the second machine includes limiting the speed of the at least one of the first machine or the second machine.

20. The method of claim 5, wherein the first machine is a first wheel tractor scraper, the second machine is a second wheel tractor scraper, and the third machine is a track-type tractor.

21. The method of claim 6, further including:

employing the machine-to-machine communication system to send a second communication relating to at least one monitored characteristic of the first machine to the second machine, and automatically controlling a speed of the second machine based on the second communication while physically contacting and pushing the first machine.

22. The method of claim 1, wherein the at least one monitored characteristic includes at least one of a speed or position.

23. The method of claim 1, further comprising:

employing the machine-to-machine communication system to send a second communication relating to an amount of a payload of the first machine to the second machine; and automatically controlling a first mechanism of one of the first machine and the second machine based on the second communication in order to engage a second mechanism of the other one of the first machine and the second machine, the engagement of the first and second mechanisms being configured to allow the first machine to pull the second machine.

24. The system of claim 8, wherein the at least one monitored characteristic includes at least one of a speed, a position, and an amount of a payload.

25. The system of claim 8, wherein the at least one controller is configured to automatically control the speed of the at least one of the first machine or the second machine by limiting the speed of the at least one of the first machine or the second machine.

26. The machine of claim 13, wherein the controller is further configured to control an operation of the machine and the additional machine.

* * * * *